US008330663B2

(12) United States Patent
Noguchi et al.

(10) Patent No.: US 8,330,663 B2
(45) Date of Patent: Dec. 11, 2012

(54) GLASS ANTENNA FOR VEHICLE

(75) Inventors: Akihiro Noguchi, Watarai-gun (JP); Yasuo Takaki, Matsusaka (JP); Yuji Katada, Matsusaka (JP)

(73) Assignee: Central Glass Company, Limited, Ube-shi (JP)

( * ) Notice: Subject to any disclaimer, the term of this patent is extended or adjusted under 35 U.S.C. 154(b) by 399 days.

(21) Appl. No.: 12/516,160

(22) PCT Filed: Sep. 16, 2008

(86) PCT No.: PCT/JP2008/066667

§ 371 (c)(1),
(2), (4) Date: May 22, 2009

(87) PCT Pub. No.: WO2010/032285

PCT Pub. Date: Mar. 25, 2010

(65) Prior Publication Data

US 2011/0043419 A1 Feb. 24, 2011

(51) Int. Cl.
*H01Q 1/32* (2006.01)

(52) U.S. Cl. ..... 343/712; 343/711; 343/704

(58) Field of Classification Search ..... 343/712, 343/713, 711, 704

See application file for complete search history.

(56) References Cited

U.S. PATENT DOCUMENTS

| | | | | |
|---|---|---|---|---|
| 5,231,410 | A | 7/1993 | Murakami et al. | |
| 6,072,435 | A | 6/2000 | Terashima et al. | |
| 6,208,303 | B1 | 3/2001 | Tachihara et al. | |
| 6,243,043 | B1 | 6/2001 | Terashima et al. | |
| 6,369,767 | B1 | 4/2002 | Oka et al. | |
| 7,091,914 | B2 * | 8/2006 | Noguchi et al. | 343/713 |
| 2005/0030235 | A1 | 2/2005 | Noguchi et al. | |
| 2007/0273597 | A1 * | 11/2007 | Noda | 343/713 |
| 2008/0106480 | A1 * | 5/2008 | Nagayama et al. | 343/713 |
| 2011/0032163 | A1 * | 2/2011 | Noguchi et al. | 343/711 |

FOREIGN PATENT DOCUMENTS

EP 1 643 587 A1 4/2006

(Continued)

OTHER PUBLICATIONS

European Search Report dated Sep. 24, 2010 (Six (6) pages).

(Continued)

*Primary Examiner* — Hoang V Nguyen
*Assistant Examiner* — Amal Patel
(74) *Attorney, Agent, or Firm* — Crowell & Moring LLP

(57) ABSTRACT

There is provided an antenna for a vehicle which is formed on a space above defogging heater strips of a rear window glass of the vehicle. The antenna includes an AM broadcast wave receiving antenna including a plurality of horizontal strips provided at intervals, at least two vertical strips which are orthogonal to the horizontal strips, and which are apart from each other, and a first feed point provided between the two vertical strips, on uppermost one of the horizontal strips or through an extension line extending from a portion of the uppermost one of the horizontal strips; and an FM broadcast wave receiving antenna which extends in a clockwise direction or in a counterclockwise direction from a second feed point provided above the uppermost one of the horizontal strips of the AM broadcast wave receiving antenna, along a part of an outermost portion of the AM broadcast wave receiving antenna to surround the AM broadcast wave receiving antenna, and which is adjacent to at least a part of the horizontal strips of the AM broadcast wave receiving antenna to achieve a capacitive coupling.

7 Claims, 5 Drawing Sheets

FOREIGN PATENT DOCUMENTS

| | | | |
|---|---|---|---|
| EP | 1 841 007 | A1 | 10/2007 |
| EP | 2 051 326 | A1 | 4/2009 |
| JP | 2-13311 | U | 1/1990 |
| JP | 11-205023 | A | 7/1999 |
| JP | 2000-101323 | A | 4/2000 |
| JP | 2000-244220 | A | 9/2000 |
| JP | 2001-136013 | A | 5/2001 |
| JP | 2003-69328 | A | 3/2003 |
| JP | 2004-153320 | A | 5/2004 |
| JP | 2005-26905 | A | 1/2005 |
| JP | 2006-197184 | A | 7/2006 |
| JP | 2006-311499 | A | 11/2006 |
| WO | WO 2006103956 | A1 * | 10/2006 |

OTHER PUBLICATIONS

Corresponding International Search Report dated Dec. 2, 2008 with partial English translation (Three (3) pages).

Corresponding Form PCT/ISA/237 dated Apr. 2007 (Three (3) pages).

* cited by examiner

GLASS ANTENNA FOR VEHICLE

TECHNICAL FIELD

The present invention relates to a glass antenna that is formed on a rear window glass of vehicles such as automobiles and receives AM radio broadcast waves and FM radio broadcast waves, particularly to a glass antenna that is suitable for receiving radio waves of FM radio broadcast waves.

BACKGROUND OF THE INVENTION

Hitherto, glass antennas for receiving AM radio broadcast waves and FM radio broadcast waves are often formed on a rear window glass of an automobile, since it requires a relatively large area for obtaining a good reception gain. Furthermore, the rear window glass of the automobile is often formed on its central region with defogging heater strips for ensuring rear visibility at the driving in rain. Accordingly, in case that the glass antenna is formed on the rear window glass, it has been forced to be formed on a space above or below the defogging heater strips.

Furthermore, in most cases, one antenna provided on the space above the defogging heater strips has been received radio waves of AM radio broadcast waves and radio waves of FM radio broadcast waves. This antenna of the AM radio-band/FM radio-band has been a grounded antenna pattern having one common feed point.

Furthermore, in case of receiving the radio waves of the AM radio broadcast waves and the radio waves of the FM radio broadcast waves by one glass antenna, in many cases, an antenna amplifier has been provided generally between an antenna feed point and a tuner so as to amplify an electromotive force insufficient to be input to the tuner, and it has been input to the tuner.

Alternatively, an impedance matching circuit has been formed in order to minimize the reduction loss of the reception gain by a feeder line between the antenna feed point and the tuner to maintain the electromotive force to become sufficient to be input to the tuner, thereby inputting it to the tuner.

In the case of sharing antennas of the AM broadcast waves and the FM broadcast waves, in many cases, with respect to the amplifier, an AM broadcast wave amplifier and an FM broadcast wave amplifier are separately provided, thereby amplifying the received power and then inputting it to the tuner. Alternatively, also with respect to the impedance matching circuit, in many cases, the reduction due to the loss of the reception sensitivity is suppressed by an AM broadcast wave impedance matching circuit and an FM broadcast wave impedance matching circuit in the route that the radio waves received by the antenna are transmitted to the tuner.

As one in which a glass antenna is formed on an upper space of a vehicular rear window glass and an amplification is conducted by an amplifier, for example, there is described in a microfilm of Japanese Utility Model Application No. 63-89982 (Japanese Utility Model Laid-open Publication No. 2-13311) an amplifier attachment structure of a vehicular glass antenna, which has a glass antenna in which an antenna conductor is formed at a predetermined position of a vehicular window glass sheet and an amplifier for amplifying the reception sensitivity of the glass antenna, and in which the amplifier is directly connected to a feed terminal portion of the glass antenna by means such as soldering, brazing or a conductive adhesive bonding, thereby reducing the gain loss due to the capacity loss at a feed line portion between the glass antenna and the amplifier (A Patent Document 1).

In a glass antenna for a vehicle in Japanese Patent Application Publication No. 11-205023, there are provided a first coil, a second coil, a first antenna conductor provided in a window glass sheet of a vehicle, and a second antenna conductor provided in the window glass sheet of the vehicle. This glass antenna generates first resonance including, as resonance elements, impedance of the first antenna conductor and inductance of the first coil, and generates second resonance including, as resonance elements, impedance of the second antenna conductor and inductance of the second coil. The second antenna conductor has a length and a shape of the conductor for a first received frequency band. The first antenna conductor has a length and a shape of the conductor for a second received frequency band higher in the frequency than the first receiving frequency band. A resonance frequency of the first resonance and a resonance frequency of the second resonance are, respectively, frequencies to improve the sensitivity of the first received frequency band. The first antenna conductor and the second antenna conductor are electrically connected with each other (A Patent Document 2).

Patent Document 1: a microfilm of Japanese Utility Model Application No. 63-89982 (Japanese Utility Model Laid-open Publication No. 2-13311)

Patent Document 2: Japanese Patent Application Publication No. 11-205023

SUMMARY OF THE INVENTION

The above-mentioned Patent Document 1 describes a structure in which a single antenna system for receiving the AM broadcast waves and the FM broadcast waves is formed on the space of the rear window glass of the automobile, and in which the amplifier for amplifying the reception sensitivity of the glass antenna is attached to a feed terminal of the antenna.

However, in such a case that the AM antenna and the FM antenna are formed into the single antenna, it is necessary to conduct a tuning for satisfying both frequency bands of the AM band and the FM band. Therefore, there has been a problem in which the tuning operation becomes complicated to increase man-hour, and a problem in which the high reception sensitivity is not obtained when the FM broadcast radio waves are received since the single antenna receives the both bands of the AM broadcast radio wave and the FM broadcast radio wave.

Furthermore, different amplifier circuits are provided for received frequency bands, that is, for the AM broadcast band and the FM broadcast band. It is necessary to make the AM broadcast wave amplifier and the FM broadcast wave amplifier have different circuits. A wave separation into both frequency bands of the AM broadcast band and the FM broadcast band is once conducted, and they are respectively amplified by the AM broadcast wave amplifier and an FM broadcast wave amplifier, and combined. Therefore, the external size of the antenna amplifier became large, and its appearance was also inferior in the case of attaching it at the feed point or its vicinity. Even if it is formed on an inner side of an interior member of a side pillar of a rear window, not only it became an obstacle, but also its production cost was never low.

On the other hand, in the patent document 2, there are provided the antennas for two broadcast bands of the first antenna for the high band and the second antenna for the low band which are provided above the defogger of the rear window glass of the automobile. The first antenna and the second antenna are capacitive-coupled. The different resonances are used by the respective antennas to improve the sensitivities of the two frequency bands. It is possible to independently tune the frequency bands of the AM radio band and the FM radio band. Therefore, it is possible to simplify the tuning operation. However, when the glass antenna according to the present invention is mass-produced, there is a problem that it is not necessarily possible to obtain the satisfactory reception characteristic by the variation of the element of each circuit.

The present invention provides an antenna that receives an AM broadcast wave and an FM broadcast wave, that is formed on a space above defogging heater strips of a rear window glass of an automobile, and that solves the above-mentioned problems and particularly does not require an FM radio broadcast wave amplifier or matching circuit, while making the reception gain of FM radio broadcast waves high.

The present invention provides a glass antenna (first glass antenna) for a vehicle which is formed on a space above defogging heater strips of a rear window glass of the vehicle, the antenna comprising: an AM broadcast wave receiving antenna including a plurality of horizontal strips provided at intervals, at least two vertical strips which are orthogonal to the horizontal strips, and which are apart from each other, and a first feed point provided between the two vertical strips, on uppermost one of the horizontal strips or through an extension line extending from a portion of the uppermost one of the horizontal strips; and an FM broadcast wave receiving antenna which extends in a clockwise direction or in a counterclockwise direction from a second feed point provided above the uppermost one of the horizontal strips of the AM broadcast wave receiving antenna, along a part of an outermost portion of the AM broadcast wave receiving antenna to surround the AM broadcast wave receiving antenna, and which is adjacent to at least a part of the horizontal strips of the AM broadcast wave receiving antenna to achieve a capacitive coupling.

It is optional that the first glass antenna is a glass antenna (second glass antenna) for the vehicle, wherein the FM broadcast wave receiving antenna is an L-shaped or U-shaped element including a second horizontal strip which extends in a horizontal direction from the second feed point, and which is adjacent to the horizontal strip of the AM broadcast wave receiving antenna to achieve the capacitive coupling, and a second vertical strip extending in a substantially vertical direction or in an arc from an end of the second horizontal strip, along outsides of the plurality of the horizontal strips of the AM broadcast wave receiving antenna.

It is optional that the first or second glass antenna is a glass antenna (third glass antenna) for the vehicle, wherein the FM broadcast wave receiving antenna includes one or two return horizontal antenna which is formed by returning an end of the FM broadcast wave receiving antenna, and which is adjacent to the end of the horizontal strip of the AM broadcast wave receiving antenna to achieve the capacitive coupling.

It is optional that one of the first to third glass antennas is a glass antenna (fourth glass antenna) for the vehicle, wherein the FM broadcast wave receiving antenna includes two FM broadcast wave receiving antennas which are provided independently, and which extend, respectively, in the clockwise direction and in the counterclockwise direction from two second feed points provided on both sides of the first feed point to sandwich the first feed point, along the outermost portion of the AM broadcast wave receiving antenna to achieve a diversity reception.

It is optional that one of the first to fourth glass antennas is a glass antenna (fifth glass antenna) for the vehicle, wherein the horizontal strip of the AM broadcast wave receiving antenna is adjacent to a horizontal strip of the defogging heater strips to achieve the capacitive coupling.

It is optional that one of the first to fifth glass antennas is a glass antenna (sixth glass antenna) for the vehicle, wherein a supplementary vertical strip extends upwards from an upper end of a bus bar of the defogging heater strip; and the supplementary vertical strip is adjacent to and along at least an outside of the second vertical strip of the FM broadcast wave receiving antenna to achieve the capacitive coupling.

It is optional that one of the first to sixth glass antennas is a glass antenna (seventh glass antenna) for the vehicle, wherein the AM broadcast wave receiving antenna is connected from the first feed point through an amplifier for the AM radio broadcast wave to a tuner; and the FM broadcast wave receiving antenna is connected from the second feed points directly to the tuner without through an amplifier or an impedance matching circuit.

It is optional that one of the first to seventh glass antennas is a glass antenna (eighth glass antenna) for the vehicle, wherein the first horizontal strip of the FM broadcast wave receiving antenna from the second feed point to the end of the FM broadcast wave receiving antenna has a length of 200-500 mm in case of the FM broadcast wave receiving antenna of a frequency of 76-90 MHz for Japanese domestic use, and has a length of 150-400 mm in case of the FM broadcast wave receiving antenna of a frequency of 88-108 MHz for North America, Europe, and Australia; a length of a portion that the second horizontal strip or the return horizontal strip of the FM broadcast wave receiving antenna and the horizontal strip of the AM broadcast wave receiving antenna are adjacent to each other to achieve the capacitive coupling is 200-400 mm in case of the FM broadcast wave receiving antenna of a frequency of 76-90 MHz for Japanese domestic use, and is 150-400 mm in case of the FM broadcast wave receiving antenna of the frequency of 88-108 MHz for North America, Europe, and Australia; and a distance of the portion that the second horizontal strip or the return horizontal strip of the FM broadcast wave receiving antenna and the horizontal strip of the AM broadcast wave receiving antenna are adjacent to each other to achieve the capacitive coupling is 2-30 mm in case of the FM broadcast wave receiving antenna of the frequency of 76-90 MHz for Japanese domestic use, and is 2-30 mm in case of the FM broadcast wave receiving antenna of the frequency of 88-108 MHz for North America, Europe, and Australia.

It is optional that one of the first to eight glass antennas is a glass antenna (ninth glass antenna) for the vehicle, wherein there are provided at least two vertical strips crossing the plurality of the horizontal strips of the defogging heater strips.

DETAILED DESCRIPTION

Figure 1:
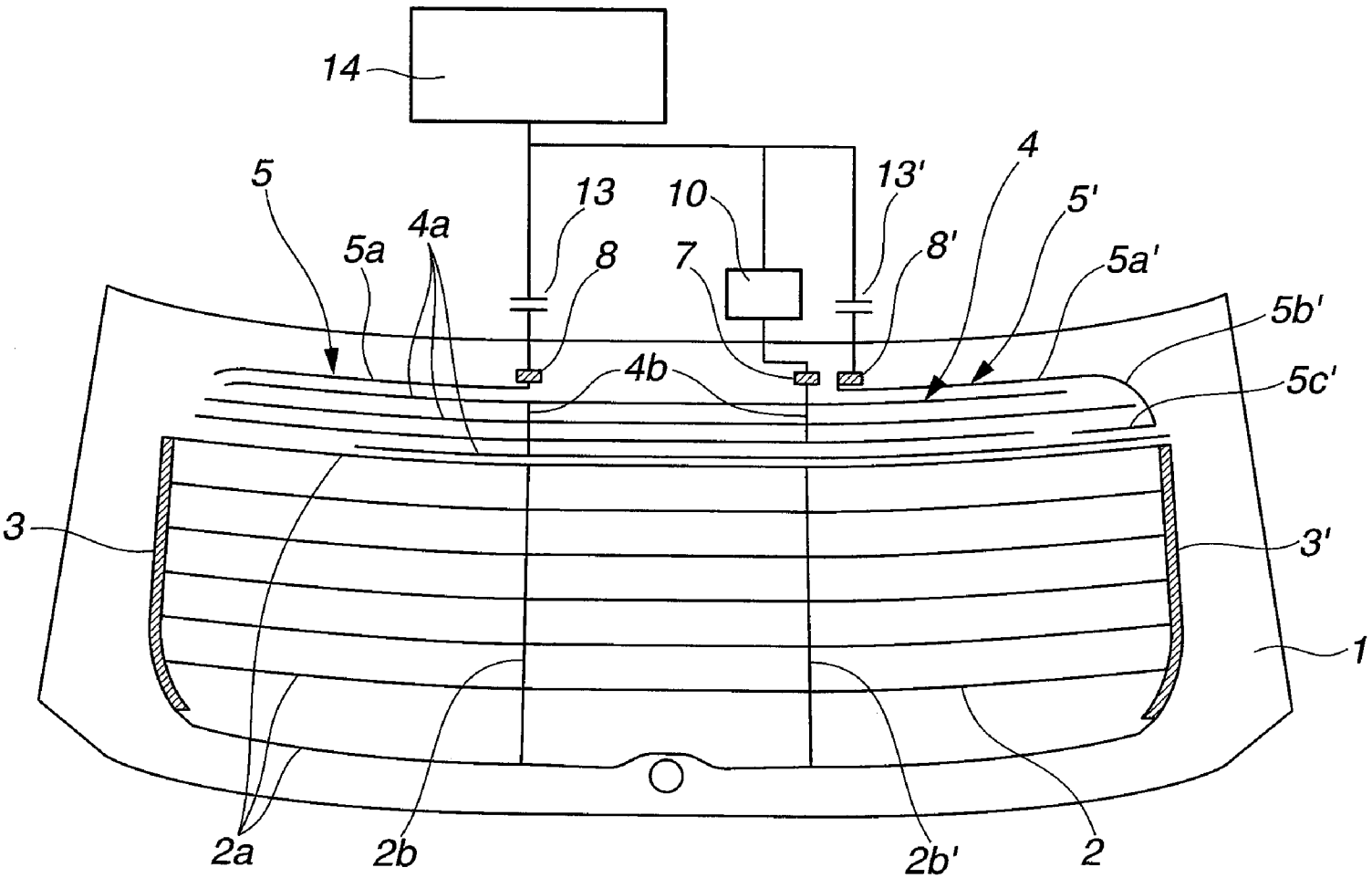
FIG. 1 is a front view showing a glass antenna provided to a rear window glass for a vehicle, according to a first embodiment of the present invention.

A part of a second horizontal strip or a return strip of an FM broadcast wave receiving antenna provided in a space above defogging heater stripes (defogger) of a rear window glass of a vehicle was adjacent to at least a part of an end of one of a plurality of horizontal strips of an AM broadcast wave receiving antenna to achieve a capacitive coupling. With this, it was possible to greatly improve the reception sensitivity of the FM broadcast wave receiving antenna. It became unnecessary to connect an amplifier and an impedance matching circuit between the second feed point of the FM broadcast wave receiving antenna and the tuner.

The uppermost horizontal strip of the defogging heater stripes (defogger) was adjacent to the lowermost horizontal strip of the AM broadcast wave receiving antenna to achieve the capacitive coupling. With this, it is possible to pick up the AM broadcast wave received by the defogging heater stripes (defogger), and to further improve the reception characteristic, relative to case of receiving only by the AM broadcast wave receiving antenna 4.

Moreover, the return horizontal strips at the ends of the main antenna 5 and the sub antenna 5' for receiving the FM broadcast wave were adjacent to the uppermost horizontal strip of the defogging heater strip (defogger) to achieve the capacitive coupling. Accordingly, it is possible to pick up the FM broadcast wave received by the defogging heater stripes (defogger), and to improve the reception characteristic, relative to case of receiving only by the main antenna 5 or the sub-antenna 5' for receiving the FM broadcast wave.

In this way, the AM broadcast wave receiving antenna and the FM broadcast wave receiving antenna were divided into two antennas. With this, it became only necessary to independently respectively tune the AM broadcast wave receiving antenna and the FM broadcast wave receiving antenna, the tuning operation became easy, and the tuning became possible by fewer man-hours.

Moreover, in the conventional apparatus, the amplifier for the AM broadcast wave band and the amplifier for the FM broadcast wave band were received in a receiving box, and disposed in the vicinity of a pillar of the rear window glass. However, it became unnecessary to have an FM broadcast wave band amplifier that had occupied most of the volume of the receiving case. With this, the size of the receiving case became remarkably compact by a factor of about several numbers. Moreover, it became possible to greatly reduce the production cost due to the necessity of only an AM broadcast wave amplifier.

The present invention provides an antenna in which an AM broadcast wave receiving antenna 4 and an FM broadcast wave receiving antenna 5 are formed on the space above defogging heater strips 2 of a vehicular rear window glass 1 to have an adjacent position and separate systems. The defogging heater strips 2 (called defogger) are formed of a plurality of substantially horizontal heater strips 2*a* that are disposed in parallel in a central region of the vehicular rear window glass 1, and connected at their both ends with conductive bus bars 3, 3'. The defogging heater stripes 2 are arranged to evaporate the moisture on the window glass surface by being applied with the current, and to defog.

As shown in FIGS. 1 to 6, the AM broadcast wave receiving antenna 4 includes a plurality of horizontal strips provided at intervals, at least two vertical strips which are apart from each other, and which are orthogonal to the horizontal strips, and a first feed point 7 disposed at least between the two vertical strips, on the uppermost horizontal strip or through an extension line extending from a portion of the uppermost horizontal strip.

The at least two vertical strips of the AM broadcast wave receiving antenna 4 extend from the uppermost one of the horizontal strips. At least one of the at least two vertical strips extends so as to be orthogonal to all of the horizontal strips. The other of the at least two vertical strips is connected with the horizontal strips so as to be orthogonal to all or a part of the horizontal strips.

The vertical strips 4*b*, 4*b* are connected and crossed with the plurality of horizontal strips 4*a*, 4*a*, . . . , and located near positions to divide substantially equally the plurality of the horizontal strips 4*a*, 4*a*, . . . into three sections. However, the horizontal strips 4*a*, 4*a*, . . . may not have the identical length to be depart from each other in the leftward and rightward directions. Moreover, the length of one of the left and right may be slightly short. Accordingly, it is not necessary to be bilaterally symmetrical.

The positions to divide substantially equally the plurality of the horizontal strips 4*a*, 4*a*, . . . into three sections are near positions to divide substantially equally the maximum width of the horizontal strips 4*a*, 4*a*, . . . into three sections. The positions of the vertical strips 4*b*, 4*b* are not limited to these positions. The vertical strips 4*a*, 4*a*, . . . may be further apart from each other in the leftward and rightward directions to positions to divide substantially equally the plurality of the horizontal strips 4*a*, 4*a*, . . . into four sections on the leftmost and rightmost positions.

It is preferable that the lowermost one of the horizontal strips 4*a* of the AM broadcast wave receiving antenna 4 is adjacent to the uppermost one of the horizontal strips 2*a* of the defogging heater strips 2 to achieve the capacitive coupling. In this case, it is possible to pick up the AM radio broadcast radio wave which is received by the defogger.

The FM broadcast wave receiving antenna 5 extends in the clockwise direction or in the counterclockwise direction, from the second feed point 8 provided above the uppermost horizontal strip 4*a* of the AM broadcast wave receiving antenna 4, along a part of the outermost portion of the AM broadcast wave receiving antenna 4 to surround the AM broadcast wave receiving antenna 4. The FM broadcast wave receiving antenna 5 is adjacent to at least a part of the horizontal strip 4*a* of the AM broadcast wave receiving antenna 4 to achieve the capacitive coupling.

The FM broadcast wave receiving antenna 5, 5' may have an L-shape including at least second horizontal strips 5*a*, 5*a*' which extend from the second feed points 8, 8', which are adjacent to the uppermost one of the horizontal strips 4*a* of the AM broadcast wave receiving antenna 4 to achieve the capacitive coupling; and a second vertical strip 5*b* which extends in the substantially vertical direction or in an arc, from the end of the second horizontal stripe 5*a* along the outline of the outside of the plurality of the horizontal strips 4*a*, 4*a*, . . . of the AM broadcast wave receiving antenna 4. Moreover, the FM broadcast wave receiving antennas 5, 5' may have a U-shape which extend from the end of the second vertical strip 5*b* along the lower part of the lowermost one of the horizontal strips 4*a* of the AM broadcast wave receiving antenna 4, or returns from the midpoint of the horizontal strip 4*a*, 4*a*, . . . .

The return horizontal strip 5*c* formed by turning the end of the FM broadcast wave receiving antenna 5 may be one or two. A part of the one or two of the return horizontal strip 5*c* may be adjacent to a part of the end of one of the horizontal strip 4*a*, 4*a*, . . . of the AM broadcast wave receiving antenna 4 to achieve the capacitive coupling.

In case of two return horizontal strips 5*c*, it is preferable that the two return horizontal strips 5*c* sandwich the part of the end of one of the horizontal strips 4*a*, 4*a*, . . . of the AM broadcast wave receiving antenna 4. In this case, it is possible to effectively pick up the radio wave received by the AM broadcast wave receiving antenna 4 from the vicinity portion.

It is preferable that supplementary vertical strips 2*c*, 2*c*' extending in the upward direction from the upper ends of the bus bars 3, 3' of the defogging heater strips 2 are adjacent to at least the outside of the second vertical strip 5*b* of the FM broadcast wave receiving antenna 5 to achieve the capacitive coupling. With this, it is possible to pick up the radio wave for the FM radio broadcast wave which is received by the defogging heater stripes 2, by the supplementary vertical strips 2*c*, 2*c*'.

It is preferable that there are provided two separate antenna systems extending, respectively, in the clockwise direction and in the counterclockwise direction, from two second feed points 8, 8' provided on the both sides of the first feed point 7 of the AM broadcast wave receiving antenna 4 to sandwich the first feed point 7, along the outermost portion of the AM broadcast wave receiving antenna 4, so as to achieve the diversity reception.

It is possible to connect from the first feed point 7 of the AM broadcast wave receiving antenna 4 through the AM radio broadcast wave amplifier 10 to the tuner 14. It is possible to connect from the second feed points 8, 8' of the FM broadcast wave receiving antenna 5, 5' directly to tuner 14 without through the amplifier or the impedance matching circuit.

It is optional to connect from the second feed points 8, 8' of the FM broadcast wave receiving antenna 5, 5' through the amplifier or the impedance matching circuit to the tuner 14.

It is preferable that the lengths of the FM broadcast wave receiving antennas 5, 5' extending from the second feed points 8, 8' to the ends are 200-500 mm in case of the FM broadcast wave receiving antenna of the frequency of 76-90 MHz for Japanese domestic use, and that the lengths of the FM broadcast wave receiving antenna 5, 5' from the second feed points 8, 8' to the ends are 150-400 mm in case of the FM broadcast wave receiving antenna of the frequency of 88-108 MHz for North America, Europe, and Australia.

It is preferable that the length and the distance of the strips of portion that the second horizontal strips 5*a*, 5*a*' or the return strips 5*c*, 5*c*' of the FM broadcast wave receiving antenna 5, 5 and the horizontal strip of the AM broadcast wave receiving antenna are adjacent to each other to achieve the capacitive coupling are 200-500 mm, 2-30 mm, preferably 5-15 mm in case of the FM broadcast wave receiving antenna of the frequency of 76-90 MHz for the Japanese domestic use. The length and the distance of the strips of portion that the second horizontal strips 5*a*, 5*a*' or the return strips 5*c*, 5*c*' of the FM broadcast wave receiving antenna 5, 5 and the horizontal strip of the AM broadcast wave receiving antenna were adjacent to each other to achieve the capacitive coupling are 150-400 mm, 2-30 mm in case of the FM broadcast wave receiving antenna of the frequency of 88-108 MHz for North America, Europe, and Australia. There were provided at least two vertical strips 2*b*, 2*b*' to be orthogonal to the plurality of the horizontal strips 2*a* of the defogging heater strips.

It is possible to achieve the sufficient reception characteristic by one of the FM broadcast wave receiving antennas 5, 5'. However, it is preferable that one of the FM broadcast wave receiving antennas 5, 5' is used as a main antenna, and the other of the FM broadcast wave receiving antennas 5, 5' is used as a sub-antenna to achieve the diversity reception, and followed by input to the tuner 14. With this, it is possible to improve the directional characteristic, relative to a case of receiving only by one of the FM broadcast wave receiving antenna 5, 5' and inputting to the tuner 14.

The defogging heater strips 2 are provided in a central region of the rear window glass 1. The plurality of substantially horizontal heater strips 2*a* are disposed in the substantially horizontal manner. The both ends of the heater strips 2*a* are connected by the conductive bus bars 3, 3'. The defogging heater strips 2 are energized and heated by a direct power source (not shown).

The vertical strips 2*c*, 2*c*' connecting the points to divide substantially equally the plurality of the horizontal strips 2*a* of the defogging heater strips 2 into the three sections are neutral strips which are not energized, and which are not defogging heater strips. The vertical strips 2*c*, 2*c*' are effective to make the defogging heater strips 2 operate as the antenna, and to improve the reception gain of the radio wave of the AM/FM broadcast wave by using the radio wave received by the defogging heater strips 2. However, the vertical strips 2*c*, 2*c*' may not be necessarily provided.

Figure 2:
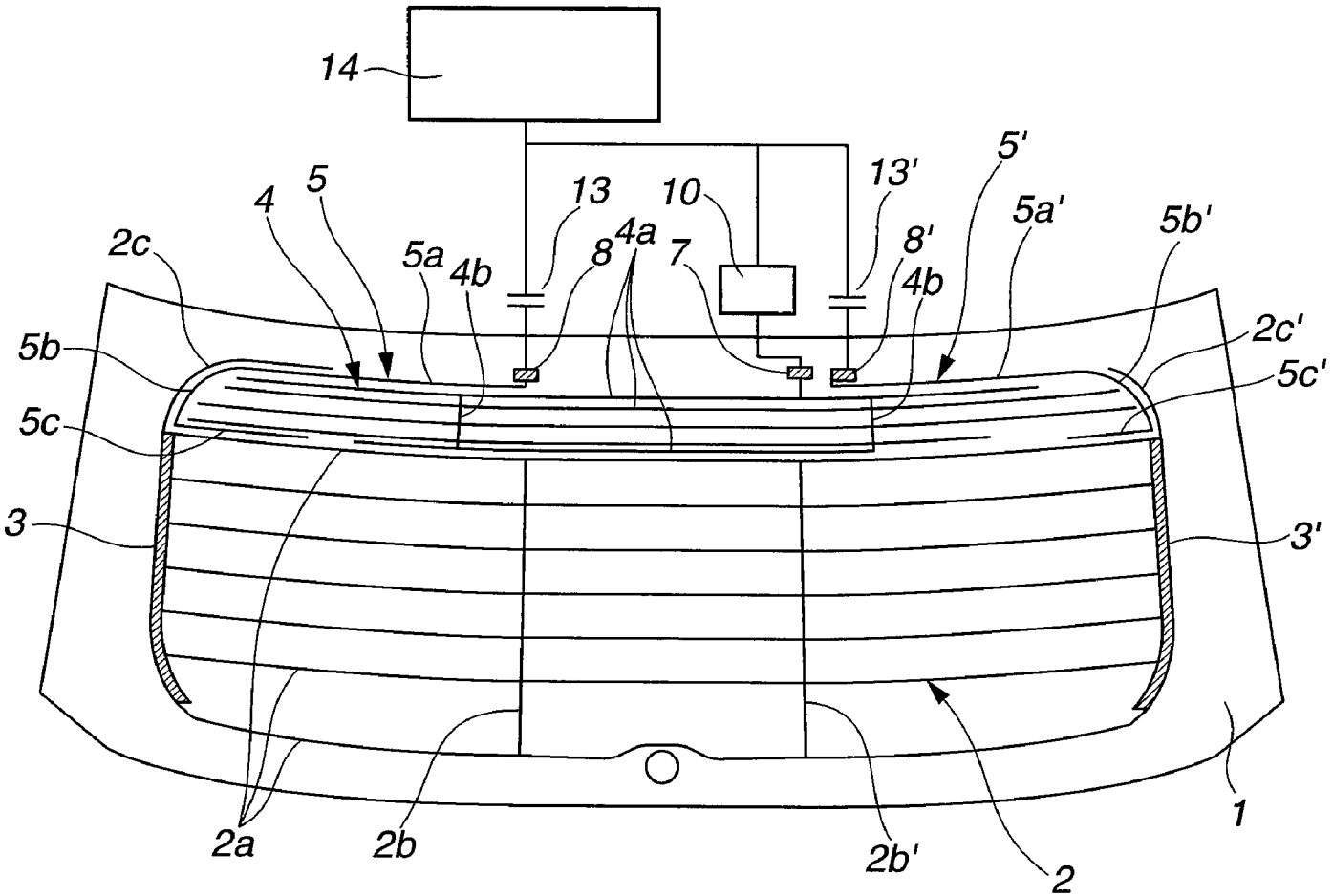
FIG. 2 is a front view showing a glass antenna provided to a rear window glass for a vehicle, according to a second embodiment of the present invention.
Figure 3:
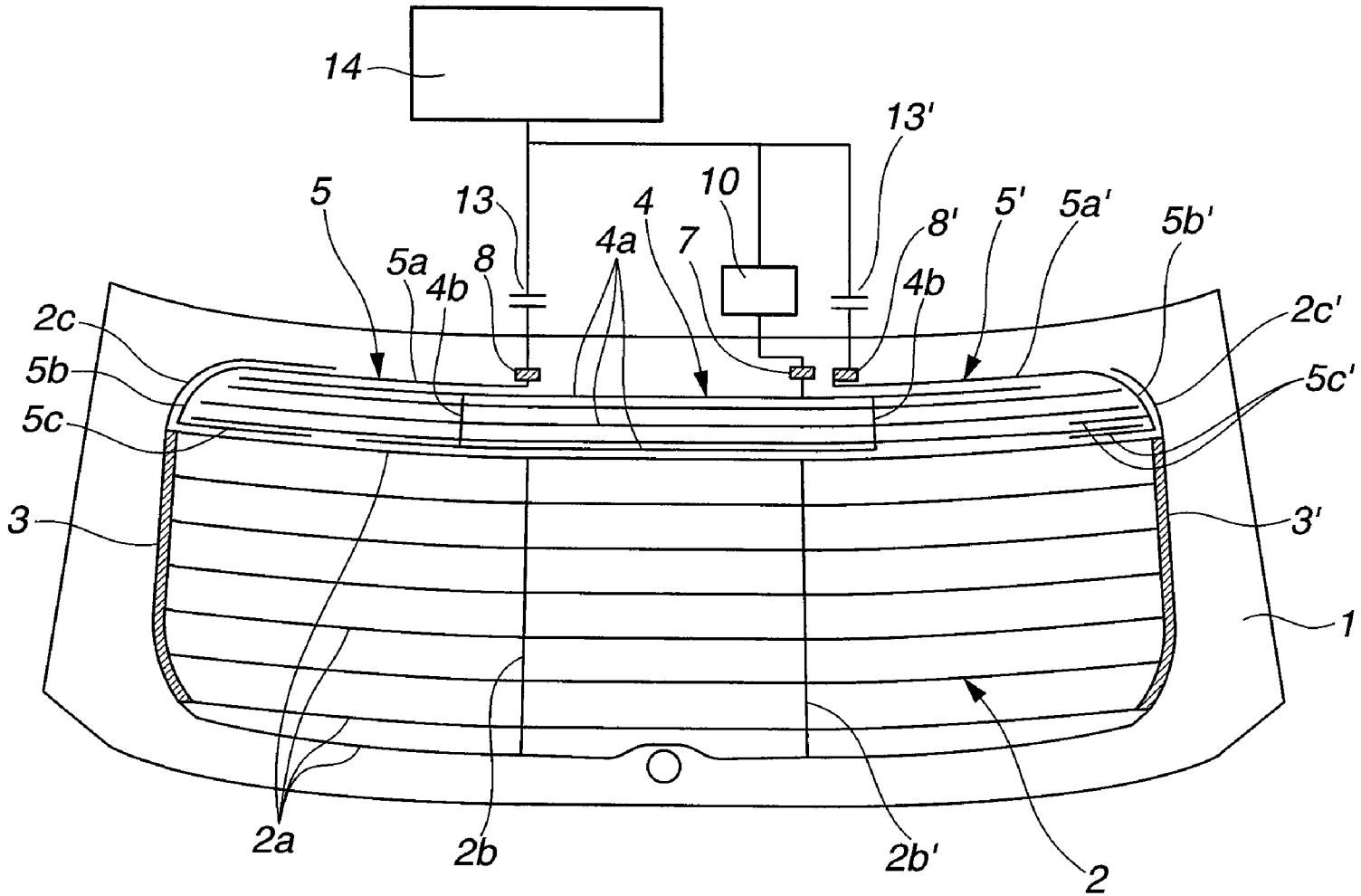
FIG. 3 is a front view showing a glass antenna provided to a rear window glass for a vehicle, according to a third embodiment of the present invention.
Figure 4:
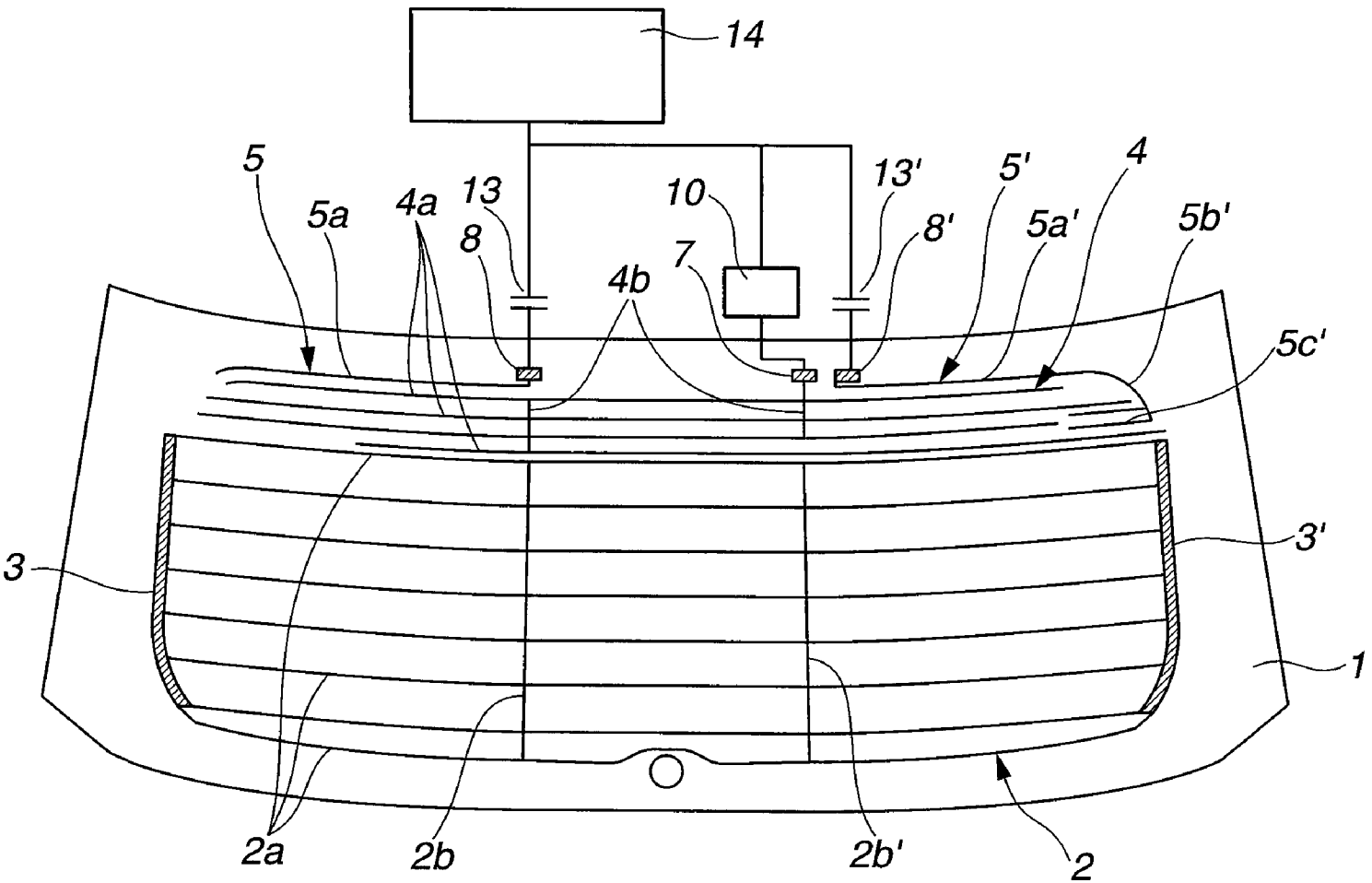
FIG. 4 is a front view showing a glass antenna provided to a rear window glass for a vehicle, according to a fourth embodiment of the present invention.

The supplementary vertical strips 2*c*, 2*c*' shown in FIGS. 2-4, and extending in the upward direction from the upper ends of the bus bar 3, 3' of the defogging heater strips 2 may not be necessarily provided.

Moreover, the supplementary vertical strips 2*c*, 2*c*' are adjacent to the outsides of the second vertical strips 5*b* of the FM broadcast wave receiving antenna 5 to achieve the capacitive coupling. With this, it is possible to pick up the radio wave for the FM radio broadcast wave which is received by the defogging heater strips 2, through the supplementary vertical strips 2*c*, 2*c*', to effectively achieve the broader bandwidth of the frequency characteristic, and to effectively improve the reception sensitivity.

It is possible to obtain a good reception sensitivity by the FM broadcast wave receiving antenna according to the present invention, without connecting an amplifier or an impedance matching circuit between the second feed points of the FM broadcast wave receiving antenna and the tuner. However, it is possible to further improve the reception sensitivity by connecting an amplifier or impedance matching circuit.

In the following, operation of the present invention is described.

In the present invention, there were formed independent antennas of the AM broadcast wave receiving antenna 4 and the FM broadcast wave receiving antenna 5. Therefore, they can be tuned to have strip lengths suitable for respective reception frequencies. The tuning operation is easy.

Furthermore, as shown in FIG. 1, similar to the conventional apparatus, the radio waves for the AM broadcast waves are amplified by the AM broadcast wave band amplifier 10 and input to the tuner 14. Capacitors 13, 13' for shielding the frequency band of the AM radio broadcast wave were connected in series to the vicinity of the output side of the feed points 8, 8' of the FM broadcast wave receiving antennas 5, 5', in order to prevent the AM broadcast wave received signals from leaking to the tuner 14 side through the FM broadcast wave receiving antennas 5 that achieves the capacitive coupling together with the AM broadcast wave receiving antenna 4.

On the other hand, the FM broadcast wave antenna 5 can pick up the radio waves for the FM broadcast wave band received by the AM broadcast wave antenna 4 by making the second horizontal strip(s) 5*a*, 5*a*' or the return horizontal strip(s) 5*c*, 5*c*' of the FM broadcast wave receiving antenna 4 adjacent to a portion of the end of one of the horizontal strips 4*a*, 4*a*, . . . of the AM broadcast wave receiving antenna 4 to achieve the capacitive coupling. With this, it is possible to improve the reception sensitivity of the FM broadcast wave receiving antenna 5, and it is not necessary to connect an FM broadcast wave band amplifier or an impedance matching circuit between the second feed point of the FM broadcast wave receiving antenna 5 and the tuner 14.

Moreover, portions of the second horizontal strips 5*a*, 5*a*' or the return horizontal strips 5*c*, 5*c*' of the FM broadcast wave receiving antenna 5 were adjacent to the portions of the horizontal strips 4*a* of the AM broadcast wave receiving antenna 4 to achieve the capacitive coupling. Furthermore, in case in which the return horizontal strips 5*c*, 5*c*' are provided at the end of the FM broadcast wave receiving antenna 5, the portions of the ends of the return horizontal strips 5*c*, 5*c*' are adjacent to the ends of the horizontal strip 4*a* of the AM broadcast wave receiving antenna 4 to achieve the capacitive coupling. In these cases, it is possible to more surely achieve the capacitive coupling, and to obtain the stable performance.

As shown in FIGS. 2-4, the supplementary vertical strips 2*c*, 2*c*' extending upwardly from the upper ends of the bus bars 3, 3' of the heating conductive strips 2 were adjacent to at least the outside of the vertical strips 5*b* of the FM broadcast wave receiving antenna 5 to achieve the capacitive coupling. With this, it is possible to pick up the radio wave for the FM radio broadcast waves received by the defogging heater strips 2, through the supplementary vertical strips 2*c*, 2*c*', and to improve the reception gain.

One of the FM broadcast wave receiving antennas was used as the main antenna 5, and the other of the FM broadcast wave receiving antennas was used as the sub antenna 5'. However, either of the FM broadcast wave receiving antennas may be used as the main antenna.

In a case in which the sub antenna 5' for receiving the FM broadcast wave is disposed in the space above the defogging heater strips 2, it is possible to obtain the antenna sensitivity substantially identical to the antenna sensitivity of the main antenna 5 for receiving the FM broadcast wave, to thereby achieve the diversity reception by the main antenna 5 and the sub antenna 5', and thereby to complement each other's low reception characteristic and low directional characteristic.

Hereinafter, the present invention is illustrated in detail with reference to the drawings.

First Embodiment

As shown in FIG. 1, the AM broadcast wave receiving antenna 4 and the FM broadcast wave receiving main and sub antennas 5 and 5' of the frequency of 88-108 MHz for North America, Europe and Australia were provided in the upper space of the defogging heater strips 2 of the rear window glass for the automobile.

The AM broadcast wave receiving antenna 4 included four horizontal strips 4*a*, 4*a*, . . . provided at intervals, and two vertical strips 4*b* and 4*b* provided at positions to divide substantially equally the horizontal strips into three sections so as to be orthogonal to the horizontal strips. One of the two vertical stripes 4*b* was orthogonal to the four horizontal strips from the uppermost horizontal strip to the lowermost horizontal stripe. The other of the two vertical strips 4*b* was orthogonal to the horizontal strips from the uppermost horizontal strip to the third horizontal strip. The other of the two vertical strips 4*b* was connected through an extension line with the first feed point 7 provided slightly above an intersection point between the other of the two vertical strips 4*b* and the uppermost horizontal strip.

The lowermost horizontal strip 4*a* of the plurality of the horizontal strips 4*a*, 4*a*, . . . had a length shorter than lengths of the first-third horizontal strips 4*a*. The lowermost horizontal strip 4*a* was adjacent to the uppermost heater strip 2*a* of the defogging heater strips 2 to achieve the capacitive coupling.

On the other hand, the FM broadcast wave receiving main antenna 5 is an antenna strip which extends in the counterclockwise direction from the second feed point 8 provided near a position above the vertical strip of the AM broadcast wave receiving antenna 4, and which is adjacent to the AM broadcast wave receiving antenna 4 to achieve the capacitive coupling.

Moreover, the FM broadcast wave receiving sub antenna 5' included a second horizontal strip 5*a*' which extends in the clockwise direction from the second feed point 8' provided near the right side of the first feed point 7, along the uppermost horizontal strip 4*a* of the AM broadcast wave receiving antenna 4, and which is adjacent to the uppermost horizontal strip 4*a* of the AM broadcast wave receiving antenna 4 to achieve the capacitive coupling, a second vertical strip 5*b*' which extends in a substantially vertical direction to surround the right ends of the horizontal strips of the AM broadcast wave receiving antenna 4, and a return strip 5*c*' which is returned from that end of the second vertical strip 5*b*', and which is adjacent to the end of the lowermost horizontal strip 4*a* on the upper side to achieve the capacitive coupling.

The AM broadcast wave receiving antenna 4 was connected from the first feed point 7 through an AM radio broadcast wave band amplifier 10 to a tuner 14. The FM broadcast wave receiving antenna 5, 5' was connected from the second feed points 8, 8' to the tuner 14, without through an FM broadcast wave amplifier or an impedance matching circuit.

The glass plate 1 has a substantially trapeziform shape. The glass plate 1 has outline dimensions of an upper side of 1,100 mm, a lower side of 1,300 mm, and a height of 500 mm. An inside size of the flange of the window flame are an upper side of 1,000 mm, a lower side of 1,100 mm, and a height of 400 mm.

Moreover, lengths of the strips of the AM broadcast wave receiving antenna 4 according to the present invention are described below.

Lengths of the horizontal strips 4*a* (from the upper side)= 860 mm, 900 mm, 880 mm, and 860 mm Distances between the horizontal strips 4*a*=20 mm Lengths of the vertical strips 4*b*, 4*b*=70 mm, 50 mm Distance between the vertical strips 4*b*, 4*b*=300 mm The length of each strip of the FM broadcast wave receiving antennas 5, 5' according to the present invention is as follows.

Lengths of the second horizontal strips 5*a*, 5*a*'=450 mm, 450 mm

Length of the second vertical strip 5*b*'=70 mm

Length of the return horizontal strip 5*c*'=150 mm

Distances between the second horizontal strips 5*a*, 5*a*' of the FM broadcast wave receiving antenna 5, 5' and the uppermost horizontal strip 4*a* of the AM broadcast wave receiving antenna 4, and distance between the return horizontal 5*c*' of the FM broadcast wave receiving antenna 5' and the lowermost horizontal strip 4*a* of the AM broadcast wave receiving antenna 4 were, respectively, 5 mm.

The first feed point 7 is located at a position which is on the right side from the center line of the glass sheet by 150 mm, and at which the vertical strip 4*b* of the AM broadcast wave receiving antenna 4 and the vertical strip 2*b*' of defogger 2 are located.

On the other hand, the second horizontal strip 5*a* of the FM broadcast wave receiving main antenna 5 was adjacent to the uppermost horizontal strip 4*a* of the AM broadcast wave receiving antenna 4 from the left end by 450 mm. The horizontal strip 5*a*' of the FM broadcast wave receiving sub antenna 5' was adjacent to the uppermost horizontal strip 4*a* of the AM broadcast wave receiving antenna 4 from the right end by 210 mm. The return horizontal strip 5*c*' was adjacent to the lowermost horizontal strip 4*a* of the AM broadcast wave receiving antenna 4 from the right end by 100 mm.

The distance between the uppermost horizontal strip 4*a* of the AM broadcast wave receiving antenna 4 and the inside of the upper side of the flange (not shown) was 30 mm. The distance between the lowermost horizontal strip 4*a* and the uppermost heater strip 2*a* was 10 mm.

The AM broadcast wave receiving antenna 4, the FM broadcast wave receiving main antenna 5, the FM broadcast wave receiving sub antenna 5', the heating conductive strips 2, the feed points, and the bus bars are formed by printing on the glass sheet by the conductive past such as silver paste, and then baking.

Thus-obtained window glass sheet was mounted on the rear window of the vehicle. The first feed point 7 of the AM broadcast wave receiving antenna 4 was connected with the AM broadcast wave amplifier 10 by feeder lines. The FM broadcast wave receiving antennas 5, 5' were connected from the second feed points 8, 8' through the AM band shielding capacitors 13, 13' to an output terminal of the AM broadcast wave band amplifier 10, and connected with the tuner 14 by feeder lines in a state in which the radio wave for the AM broadcast wave band and the radio wave for the FM broadcast wave band were combined.

The FM broadcast wave receiving main antenna 5 and the FM broadcast wave receiving sub antenna 5' are arranged to achieve the diversity reception so as to improve the directional characteristic. Accordingly, either of the FM broadcast receiving antennas may be a main antenna.

Figure 5:
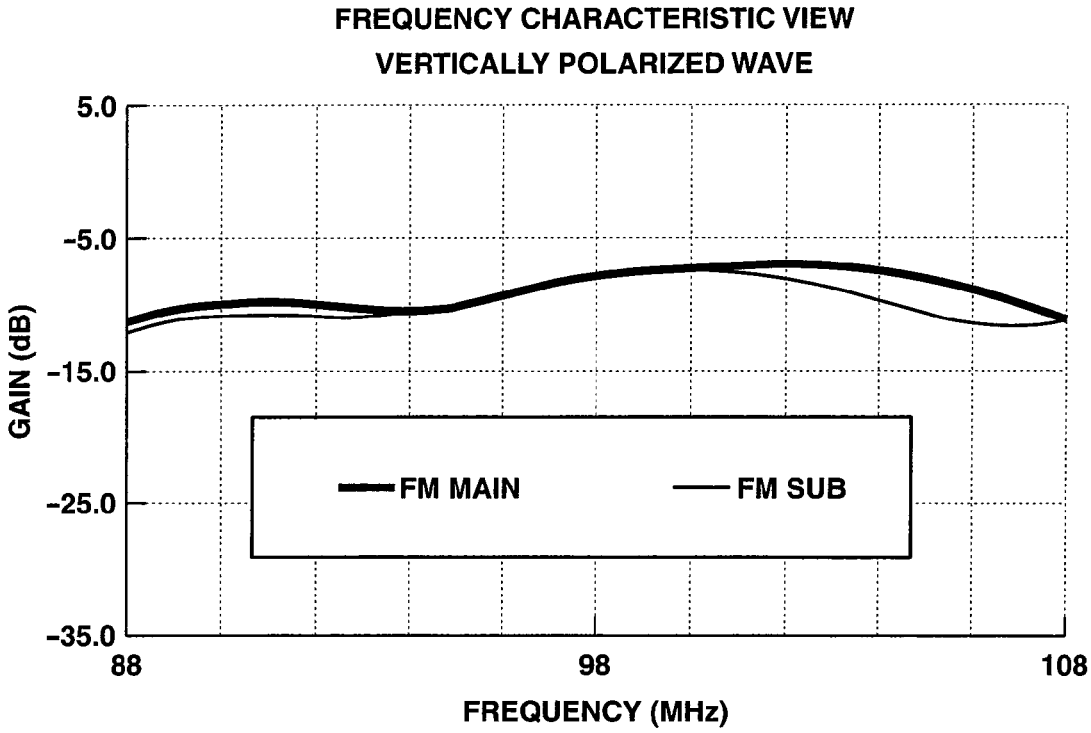
FIG. 5 is a frequency characteristic view in the first embodiment of the present invention.

As shown in FIG. 5, in case of receiving, respectively, by the FM main antenna 5 and the FM sub antenna 5', the average reception gains of the vertically polarized wave of the FM broadcast wave band of 88 MHz-108 MHz for North America, Europe, and Australia became −8.6 dB, −9.5 dB (dipole ratio). As a result of the diversity reception by the two FM antenna systems of the FM main antenna 5 and the FM sub antenna 5', the average reception gain of the vertically polarized wave of the FM broadcast wave band of 88 MHz-108 MHz became −8.3 dB (dipole ratio). With this, it was understood that the average reception gain was improved by 10 dB, relative to the average reception gain (−17 dB) in case of providing the impedance matching circuit, though there was not provided the FM broadcast wave amplifier and the impedance matching circuit. Therefore, it was found to obtain a very good reception gain.

Since the AM broadcast waves are amplified by an AM broadcast wave band amplifier in a way similar to the past, it is practically not problematic at all.

As shown in FIG. 1, the AM broadcast wave receiving antenna and the FM broadcast wave receiving antenna have been made adjacent to achieve the capacitive coupling. With this, it became unnecessary to have the FM broadcast wave receiving amplifier and the impedance matching circuit, and became only necessary to install the AM broadcast wave receiving amplifier and the AM band shielding capacitors, without lowering the reception characteristic of each of the AM broadcast waves and the FM broadcast waves.

In this case, the amplifier is only for AM. Therefore, as compared with a case in which two amplifiers are necessary for AM and FM, the total volume occupied by the amplifier became compact by a factor of several numbers, and it became possible to greatly reduce the production cost.

Second Embodiment

In a second embodiment shown in FIG. 2, there were provided an AM broadcast wave receiving antenna which is provided in a space above the defogging heater stripes of the rear window glass of the vehicle, and which includes five horizontal strips, and two vertical strips disposed to be orthogonal to the horizontal strips; an FM broadcast wave receiving main antenna and an FM broadcast wave receiving sub antenna which are shaped like U-shape to sandwich the AM broadcast wave receiving antenna from the both sides, and which are adjacent to the AM broadcast wave receiving antenna, like the first embodiment. Moreover, supplementary vertical strips extend upward from the upper ends of the two bus bar of the defogging heater strips, along the outsides of the vertical strips of the FM broadcast wave receiving main antenna and the FM broadcast wave receiving sub antenna.

The horizontal strips of the AM broadcast wave receiving antenna were five, unlike the first embodiment. Moreover, the FM broadcast wave receiving main antenna 5 extended like the U-shape in the counterclockwise direction from the second feed point 8 along the outermost portion of the AM broadcast wave receiving antenna. Furthermore, the supplementary vertical strips 2*c*, 2*c*' extended upwards form the upper ends of the bus bars, and were adjacent to the second vertical strips 5*b*, 5*b*' of the FM broadcast wave receiving antenna 5 and the FM broadcast wave receiving sub antenna 5' to achieve the capacitive coupling.

Like the first embodiment, the AM broadcast wave receiving antenna 4 was connected from the first feed point 7 through the AM broadcast wave radio amplifier 10 to the tuner 14. The FM broadcast wave receiving antenna 5, 5' was connected from the second feed points 8, 8' to the tuner 14, without through an FM broadcast wave radio amplifier or an impedance matching circuit.

The lengths of the strips of the AM broadcast wave receiving antenna 4 according to the present invention are described below.

Lengths of the horizontal strips 4*a* (from the upper side)= 860 mm, 900 mm, 880 mm, 860 mm, and 580 mm Distances between the horizontal strips 4*a*=20 mm Distance between the horizontal strips 4*a* (in the lowermost strip)=10 mm Lengths of the vertical strips 4*b*, 4*b*=70 mm, 70 mm Distance between the vertical strips 4*b*, 4*b*=460 mm The length of each stripe of FM broadcast wave receiving antenna 5, 5' according to the present invention are as follows.

Lengths of the second horizontal strips 5*a*, 5*a*'=265 mm, 240 mm

Lengths of the second vertical strips 5*b*, 5*b*'=40 mm, 30 mm

Lengths of the horizontals strips 5*c*, 5*c*'=80 mm, 75 mm

Distances between the second horizontal strips 5*a*, 5*a*' of the FM broadcast wave receiving antenna 5, 5' and the uppermost horizontal strip 4*a* of the AM broadcast wave receiving antenna 4=5 mm Distance between the return horizontal strip 5*c* of the FM broadcast wave receiving antenna 5 and the uppermost heater strip 2*a* of the defogging heater strips 2=5 mm Distance between the return horizontal strip 5*c*' of the FM broadcast wave receiving antenna 5 and the uppermost heater strip 2*a* of the defogging heater strips 2=15 mm The first feed point 7 was located on the right side from the center line of the glass sheet by 155 mm. The second feed point 8 of the FM broadcast wave receiving main antenna 5 was located on the left side of the center line of the glass sheet by 155 mm. The second feed point 8' of the FM broadcast wave receiving sub antenna 5' was located on the right side of the center line of the glass sheet by 215 mm.

On the other hand, the second horizontal strip 5*a* of the FM broadcast wave receiving main antenna 5 was adjacent to the uppermost horizontal strip 4*a* of the AM broadcast wave receiving antenna 4 from the left end of the uppermost horizontal strip 4*a* of the AM broadcast wave receiving antenna 4 by 265 mm. The second horizontal strip 5*a'* of the FM broadcast wave receiving sub antenna 5' was adjacent to the uppermost horizontal strip 4*a* of the AM broadcast wave receiving antenna 4 of the AM broadcast wave receiving antenna 4 from the right end of the uppermost horizontal strip 4*a* of the AM broadcast wave receiving antenna 4 by 200 mm. The return horizontal strip 5*c* was adjacent to the lowermost horizontal strip 4*a* of the AM broadcast wave receiving antenna 4 from the left end of the lowermost horizontal strip 4*a* of the AM broadcast wave receiving antenna 4 by 80 mm. The return horizontal strip 5*c'* was adjacent to the lowermost horizontal strip 4*a* of the AM broadcast wave receiving antenna 4 from the right end of the lowermost horizontal strip 4*a* of the AM broadcast wave receiving antenna 4 by 75 mm.

The distance between the uppermost horizontal strip 4*a* of the AM broadcast wave receiving antenna 4 and the inside of the upper side of the flange (not shown) was 30 mm. The distance between the lowermost horizontal strip 4*a* and the uppermost heater strip 2*a* was 10 mm.

The AM broadcast wave receiving antenna 4, the FM broadcast wave receiving main antenna 5, the FM broadcast wave receiving sub antenna 5', the heating conductive strips 2, the feed points, and the bus bars are formed by printing on the glass sheet by the conductive past such as silver paste, and then baking.

Thus-obtained window glass sheet was mounted on the rear window of the automobile. The first feed point of the AM broadcast wave receiving antenna 4 was connected with the AM broadcast wave amplifier 10 by feeder lines, like the first embodiment. The FM broadcast wave receiving antennas 5, 5' were connected from the second feed points 8, 8' through the AM band shielding capacitors 13, 13' to an output terminal of the AM broadcast wave band amplifier 10, and connected with the tuner 14 by the feeder line in a state in which the radio wave for the AM broadcast wave band and the radio wave for the FM broadcast wave band were combined.

Figure 6:
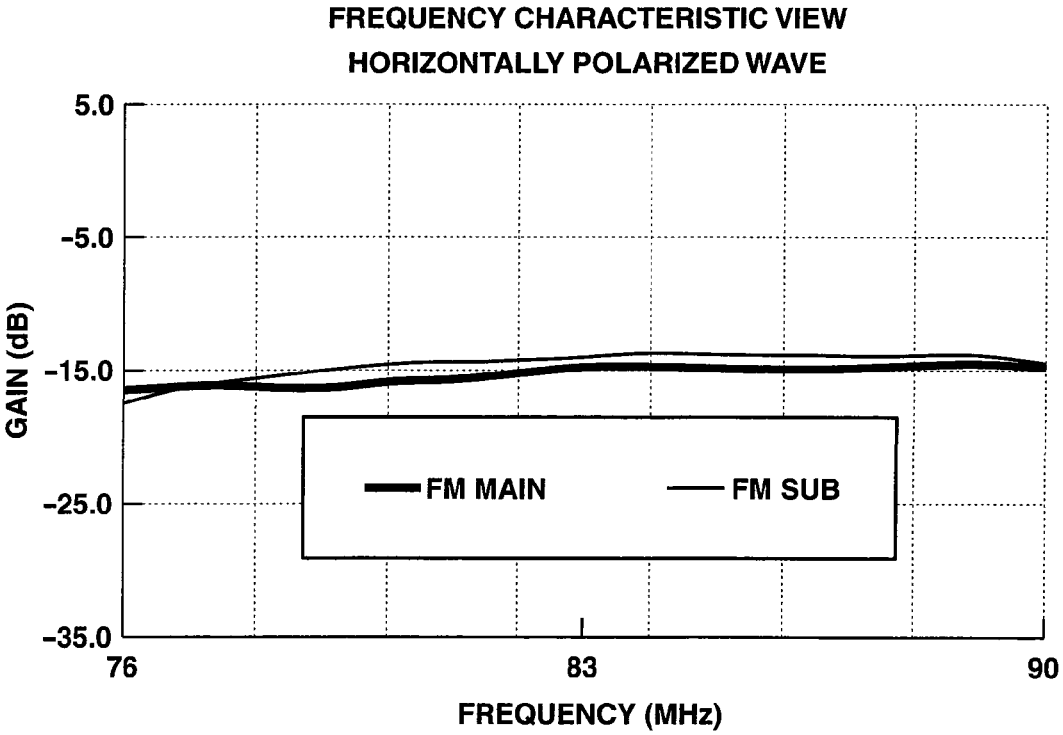
FIG. 6 is a frequency characteristic view in the second embodiment of the present invention.

As shown in FIG. 6, in case of receiving, respectively, by the FM main antenna 5 and the FM sub antenna 5', the average reception gains of the horizontally polarized wave of the domestic FM broadcast wave band of a frequency of 76 MHz-90 MHz became −15.3 dB, −14.6 dB (dipole ratio). As a result of the diversity reception of two FM antenna systems of the FM main antenna 5 and the FM sub antenna 5', the average reception gains of the horizontally polarized wave of the FM broadcast wave band of a frequency of 88 MHz-108 MHz became −11.4 dB (dipole ratio). With this, it was understood that the average reception gain was greatly improved, relative to the average reception gain (−17 dB) in case of providing the impedance matching circuit, though there was not provided the FM broadcast band wave amplifier and the impedance matching circuit.

Since the AM broadcast waves are amplified by an AM broadcast wave band amplifier in a way similar to the past, it is practically not problematic at all.

As shown in FIG. 2, the AM broadcast wave receiving antenna 4*a* and the second horizontal strips 5*a*, 5*a'* or the return horizontal strips 5*c*, 5*c'* of the FM broadcast wave receiving antenna have been made adjacent to achieve the capacitive coupling. With this, it became unnecessary to have the FM broadcast wave receiving amplifier and the impedance matching circuit, and became only necessary to install the AM broadcast wave receiving amplifier and the AM band shielding capacitors, without lowering the reception characteristic of each of the AM broadcast wave and the FM broadcast wave.

In this case, the amplifier is only for receiving the AM broadcast wave. Therefore, as compared with a case in which it is necessary to provide two amplifiers for receiving the AM broadcast wave and for receiving the FM broadcast wave, the total volume occupied by the amplifier became compact by a factor of several numbers, and it became possible to greatly reduce the production cost.

Third Embodiment

FIG. 3 shows a third embodiment which is a variation of the second embodiment. In this third embodiment, there was provided two return horizontal strips 5*c'* at the end of the substantially U-shaped sub antenna 5' which was used for receiving the domestic FM broadcast wave of the frequency of 76-90 MHz. The part of the right side end of the fourth horizontal strip of the AM broadcast wave receiving antenna 4 which was fourth from the uppermost strip was sandwiched by the two return horizontal strips 5*c'* to achieve the capacitive coupling. There were provided five horizontal strips of the AM broadcast wave receiving antenna. The lengths of the strips are substantially identical to the lengths in the second embodiment.

This embodiment is a variation of the second embodiment. In case of receiving, respectively, by the FM main antenna 5 and the FM sub antenna 5', the average reception gains of the horizontally polarized wave of the domestic FM broadcast wave band of a frequency of 76 MHz-90 MHz became −16.7 dB, −14.6 dB (dipole ratio). As a result of the diversity reception of two FM antenna systems of the FM main antenna 5 and the FM sub antenna 5', the average reception gain of the horizontally polarized wave of the FM broadcast band wave of 88 MHz-108 MHz became −11.4 dB (dipole ratio). With this, it was understood that the average reception gain was greatly improved, relative to the average reception gain (−17 dB) in case of providing the impedance matching circuit, though there was not provided the FM broadcast band wave amplifier and the impedance matching circuit.

Since the AM broadcast waves are amplified by an AM broadcast wave band amplifier in a way similar to the past, it is practically not problematic at all.

By such AM broadcast wave receiving antenna and FM broadcast wave receiving antenna, it became possible to make the FM broadcast wave receiving amplifier and the impedance matching circuit unnecessary, without lowering the reception characteristics of each of the AM broadcast wave and the FM broadcast wave.

The AM broadcast wave receiving antenna 4 was connected from the first feed point 7 to the AM broadcast wave band amplifier by the feeder line. The FM broadcast wave receiving main antenna 5 and the FM broadcast wave receiving sub antenna 5' were connected, respectively, from the second feed points 8, 8' through the AM band shielding capacitors 13, 13', to the output terminal of the AM broadcast wave band amplifier 10, and connected with the tuner 14 by the feeder line in a state in which the radio wave for the AM broadcast wave band and the radio wave for the FM broadcast wave band was combined.

The FM broadcast wave receiving main antenna 5 and the FM broadcast wave receiving sub antenna 5' were connected, respectively, from the second feed points 8, 8' through the AM band shielding capacitors 13' to the tuner 14 so as to achieve the diversity reception by the two FM broadcast wave receiving antennas 5, 5'. Accordingly, it is possible to obtain higher reception characteristic and higher directional characteristic. Moreover, it became possible to make the FM broadcast wave receiving amplifier and the impedance matching circuit unnecessary, without lowering the reception property of each of the AM broadcast waves and the FM broadcast waves.

Fourth Embodiment

FIG. 4 shows a fourth embodiment which is a variation of the first embodiment. There were provided two return horizontal strips 5*c*' at the end of the substantially U-shaped sub antenna 5' which is used for receiving the FM broadcast wave of the frequency of 88-108 MHz for North America, Europe, and Australia. The part of the right side end of the lowermost horizontal strip of the AM broadcast wave receiving antenna 4 was adjacent to the lower side of the two return horizontal strips 5*c*', 5*c*' to achieve the capacitive coupling. The lengths of the strips are substantially identical to the lengths in the first embodiment.

This embodiment is a variation of the first embodiment. In case of receiving, respectively, by the FM main antenna 5 and the FM sub antenna 5' the average reception gains of the vertically polarized wave of the FM broadcast wave band of 88 MHz-108 MHz for North America, Europe, and Australia became −9 dB, −9.5 dB (dipole ratio). As a result of the diversity reception of the two antenna systems of the FM main antenna 5 and the FM sub antenna 5', the average reception gain of the vertically polarized wave of the FM broadcast wave band of 88 MHz-108 MHz became −8.5 MHz (dipole ratio). The average reception gain was greatly improved by nearly 10 dB, relative to the average reception gain (−17 dB) in case of providing the impedance matching circuit, though there was not provided the FM broadcast band wave amplifier and the impedance matching circuit.

Since the AM broadcast waves are amplified by an AM broadcast wave band amplifier in a way similar to the past (the conventional apparatus), it is practically not problematic at all.

The AM broadcast wave receiving antenna 4 was connected from the first feed point 7 to the AM broadcast wave band amplifier 10 by the feeder line. The FM broadcast wave receiving main antenna 5 and the FM broadcast wave receiving sub antenna 5' were connected, respectively, from the second feed points 8, 8' through the AM band shielding capacitors 13, 13', to the output terminal of the AM broadcast wave band amplifier 10, and connected with the tuner 14 by the feeder line in a state in which the radio wave for the AM broadcast wave band and the radio wave for the FM broadcast wave band were combined.

The FM broadcast wave receiving main antenna 5 and the FM broadcast wave receiving sub antenna 5' were connected, respectively, from the second feed points 8, 8' through the AM band shielding capacitors 13' to the tuner 14 so as to achieve the diversity reception by the two FM broadcast wave receiving antennas 5, 5'. Accordingly, it is possible to obtain higher reception characteristic and higher directional characteristic. Moreover, it became possible to make the FM broadcast wave receiving amplifier and the impedance matching circuit unnecessary, without lowering the reception property of each of the AM broadcast waves and the FM broadcast waves.

The invention claimed is:

1. An antenna for a vehicle which is formed on a space above defogging heater strips of a rear window glass of the vehicle, the antenna comprising:

an AM broadcast wave receiving antenna including a plurality of horizontal strips provided at intervals, at least two vertical strips which are orthogonal to the horizontal strips, and which are apart from each other, and a first feed point provided between the two vertical strips, on uppermost one of the horizontal strips or through an extension line extending from a portion of the uppermost one of the horizontal strips; and an FM broadcast wave receiving antenna which extends in a clockwise direction or in a counterclockwise direction from a second feed point provided above the uppermost one of the horizontal strips of the AM broadcast wave receiving antenna, along a part of an outermost portion of the AM broadcast wave receiving antenna to surround the AM broadcast wave receiving antenna, and which is adjacent to at least a part of the horizontal strips of the AM broadcast wave receiving antenna to achieve a capacitive coupling, wherein the FM broadcast wave receiving antenna is an L-shaped or U-shaped element including a horizontal strip which extends in a horizontal direction from the second feed point, and which is adjacent to the horizontal strip of the AM broadcast wave receiving antenna to achieve the capacitive coupling, and a vertical strip extending in a substantially vertical direction or in an arc from an end of the horizontal strip of the FM broadcast wave receiving antenna, along outsides of the plurality of the horizontal strips of the AM broadcast wave receiving antenna, wherein the FM broadcast wave receiving antenna includes one or two return horizontal antenna which is formed by returning an end of the FM broadcast wave receiving antenna, and which is adjacent to the end of the horizontal strip of the AM broadcast wave receiving antenna to achieve the capacitive coupling, and wherein the FM broadcast wave receiving antenna wraps around ends of the plurality of the horizontal strips of the AM broadcast wave receiving antenna.

2. A glass antenna for a vehicle which is formed on a space above defogging heater strips of a rear window glass of the vehicle, the antenna comprising:

an AM broadcast wave receiving antenna including a plurality of horizontal strips provided at intervals, at least two vertical strips which are orthogonal to the horizontal strips, and which are apart from each other, and a first feed point provided between the two vertical strips, on uppermost one of the horizontal strips or through an extension line extending from a portion of the uppermost one of the horizontal strips; and an FM broadcast wave receiving antenna which extends in a clockwise direction or in a counterclockwise direction from a second feed point provided above the uppermost one of the horizontal strips of the AM broadcast wave receiving antenna, along a part of an outermost portion of the AM broadcast wave receiving antenna to surround the AM broadcast wave receiving antenna, and which is adjacent to at least a part of the horizontal strips of the AM broadcast wave receiving antenna to achieve a capacitive coupling, wherein the FM broadcast wave receiving antenna is an L-shaped or U-shaped element including a horizontal strip which extends in a horizontal direction from the second feed point, and which is adjacent to the horizontal strip of the AM broadcast wave receiving antenna to achieve the capacitive coupling, and a vertical strip extending in a substantially vertical direction or in an arc from an end of the horizontal strip of the FM broadcast wave receiving antenna, along outsides of the plurality of the horizontal strips of the AM broadcast wave receiving antenna, wherein the FM broadcast wave receiving antenna includes one or two return horizontal antenna which is formed by returning an end of the FM broadcast wave receiving antenna, and which is adjacent to the end of the horizontal strip of the AM broadcast wave receiving antenna to achieve the capacitive coupling, and wherein the FM broadcast wave receiving antenna includes two FM broadcast wave receiving antennas which are provided independently, and which extend, respectively, in the clockwise direction and in the counterclockwise direction from two second feed points provided on both sides of the first feed point to sandwich the first feed point, along the outermost portion of the AM broadcast wave receiving antenna to achieve a diversity reception.

3. The glass antenna for the vehicle claimed in claim 1, wherein the horizontal strip of the AM broadcast wave receiving antenna is adjacent to a horizontal strip of the defogging heater strips to achieve the capacitive coupling.

4. The glass antenna for the vehicle claimed in claim 1, wherein a supplementary vertical strip extends upwards from an upper end of a bus bar of the defogging heater strip; and the supplementary vertical strip is adjacent to and along at least an outside of the second vertical strip of the FM broadcast wave receiving antenna to achieve the capacitive coupling.

5. The glass antenna for the vehicle claimed in claim 1, wherein the AM broadcast wave receiving antenna is connected from the first feed point through an amplifier for the AM radio broadcast wave to a tuner; and the FM broadcast wave receiving antenna is connected from the second feed leads directly to the tuner without going through an amplifier or an impedance matching circuit.

6. The glass antenna for the vehicle claimed in claim 1, wherein the horizontal strip of the FM broadcast wave receiving antenna from the second feed point to the end of the FM broadcast wave receiving antenna has a length of 200-500 mm in case of the FM broadcast wave receiving antenna of a frequency of 76-90 MHz for Japanese domestic use, and has a length of 150-400 mm in case of the FM broadcast wave receiving antenna of a frequency of 88-108 MHz for North America, Europe, and Australia; a length of a portion that the horizontal strip of the FM broadcast wave receiving antenna or the return horizontal strip of the FM broadcast wave receiving antenna and the horizontal strip of the AM broadcast wave receiving antenna are adjacent to each other to achieve the capacitive coupling is 200-400 mm in case of the FM broadcast wave receiving antenna of a frequency of 76-90 MHz for Japanese domestic use, and is 150-400 mm in case of the FM broadcast wave receiving antenna of the frequency of 88-108 MHz for North America, Europe, and Australia; and a distance of the portion that the horizontal strip of the FM broadcast wave receiving antenna or the return horizontal strip of the FM broadcast wave receiving antenna and the horizontal strip of the AM broadcast wave receiving antenna are adjacent to each other to achieve the capacitive coupling is 2-30 mm in case of the FM broadcast wave receiving antenna of the frequency of 76-90 MHz for Japanese domestic use, and is 2-30 mm in case of the FM broadcast wave receiving antenna of the frequency of 88-108 MHz for North America, Europe, and Australia.

7. The glass antenna for the vehicle claimed in claim 1, wherein there are provided at least two vertical strips crossing the plurality of the horizontal strips of the defogging heater strips.

* * * * *